US005129585A

United States Patent [19]

Bauer

[11] Patent Number: 5,129,585

[45] Date of Patent: Jul. 14, 1992

[54] SPRAY-FORMING OUTPUT DEVICE FOR FLUIDIC OSCILLATORS

[76] Inventor: Peter Bauer, 13920 Esworthy Rd., Germantown, Md. 20874

[21] Appl. No.: 703,748

[22] Filed: May 21, 1991

[51] Int. Cl.[5] ..... B05B 1/08; F15B 21/12; F15C 1/08; F15C 1/22

[52] U.S. Cl. ..... 239/589.1; 137/835; 137/842

[58] Field of Search ..... 239/589.1; 137/835, 137/836, 824, 834, 839, 842

[56] References Cited

U.S. PATENT DOCUMENTS

| | | | |
|---|---|---|---|
| Re. 33,448 | 11/1990 | Bauer | 239/589.1 |
| Re. 33,605 | 6/1991 | Bauer | 239/589.1 |
| 3,016,066 | 1/1962 | Warren | 137/835 X |
| 3,507,275 | 4/1970 | Walker | 239/589.1 X |
| 3,563,462 | 2/1971 | Bauer | 239/589.1 X |
| 3,741,481 | 6/1973 | Bauer | 239/589.1 |
| 4,052,002 | 10/1977 | Stouffer et al. | 239/589.1 X |
| 4,151,955 | 5/1979 | Stouffer | 239/589.1 X |
| 4,184,636 | 1/1980 | Bauer | 239/589.1 X |
| 4,227,550 | 10/1980 | Bauer | 137/835 |
| 4,463,904 | 8/1984 | Bray, Jr. | 239/589.1 |
| 4,721,251 | 1/1988 | Kondo et al. | 239/589.1 X |

*Primary Examiner*—Andres Kashnikow
*Assistant Examiner*—Lesley D. Morris
*Attorney, Agent, or Firm*—Griffin, Branigan & Butler

[57] ABSTRACT

A spray-forming output device for fluidic oscillators to provide relatively wide-angle three-dimensional output spray patterns is connected to the output of a fluidic oscillator. The device comprises mutually counter-directed conduits whose entry regions are fed from the oscillator output and whose exit regions are connected to an interaction outlet region that includes a common outlet, the common outlet being directed substantially orthogonally with respect to the plane in which the counter-directed conduits are disposed. In one embodiment, the interaction outlet region includes an impact wall disposed at the exit regions of the counter-directed conduits proximally to the common outlet. The spray-forming output device further comprises in one embodiment a shunt inertance conduit that provides an inertance shunt path between the entry regions of the counter-directed conduits, the shunt conduit being operative in smoothing out waveforms of the alternating flows from the oscillator and also providing for load-impedance matching between the oscillator and the output device. In operation, alternating output flows from the fluidic oscillator feed the counter-directed conduits and therefrom are deflected into the common outlet of the interaction outlet region. The alternating output flows mutually interact in the interaction outlet region and issue therefrom in the form of a substantially common fluid stream that oscillates or sweeps from side to side in correspondence with the oscillation of the fluidic oscillator.

22 Claims, 7 Drawing Sheets

SPRAY-FORMING OUTPUT DEVICE FOR FLUIDIC OSCILLATORS

BACKGROUND

1. Field of the Invention

This invention relates generally to improvements in spray-forming devices, and more particularly to a spray-forming output device for fluidic oscillators and to a sprayer device employing a fluidic oscillator in combination with the spray-forming output device.

2. Prior Art and Other Considerations

Fluidic oscillator devices for the generation of oscillating or pulsating fluid output patterns have been known in the art for some time (for instance, see U.S. Pat. Nos. 3,016,066; 3,432,102; 3,507,275; 4,052,002; 4,151,955; 4,184,636; 4,463,904; 4,721,251). In all of these patents a fluid jet is caused to oscillate by means of fluid interaction using no moving parts, and the resulting fluid stream is issued into the ambient environment to disperse the fluid therein. Other fluidic oscillator devices, such as for instance disclosed in U.S. Pat. Nos. 3,563,462; 3,741,481; and 4,184,636 issue discrete pulses of fluid in alternation from two or more outlet openings.

Most known fluidic oscillators, such as for example those noted in the foregoing, rely internally upon two-dimensional flow patterns and interactions thereof. Consequently, many of these oscillators inherently tend to produce two-dimensional output patterns from their outlets. In this connection, the here used term "two-dimensional" is intended to mean an output pattern that originates in a side-to-side oscillation of a stream in a plane and that results in a substantially flat, fan-shaped, planar spray pattern with a relatively small thickness perpendicular to the plane of the spray pattern.

Many applications for spray-producing devices, however, require spray dispersal in a three-dimensional pattern. Thus, uses in which the spray is desired to cover an area can be well served only with spray-producing devices that issue a spray pattern having a conical, pyramidal or similar three-dimensional shape. Oscillatory spray can be rather advantageous in many such applications, for instance due to the resulting much-improved cleaning effects upon impact surfaces (as opposed to the effects of steady spray). Other advantageous effects of oscillatory spray include also improved heat transfer, improved wetting, massaging and vibrational effects, and the like.

Fluidic oscillator devices for producing three-dimensional spray patterns have been also disclosed, for instance, in U.S. Pat. Nos. 4,151,955 and 4,184,636.

In general, prior art fluidic oscillator devices for producing three-dimensional spray patterns have suffered from certain performance limitations with respect to spray-angle extent and spray distribution within the pattern. For instance, three-dimensional spray-pattern angles (in every direction across the pattern) much beyond 20–30 degrees have been difficult, if not impossible, to achieve, and relatively even spray distribution across the pattern, especially for wider angles, has been virtually unattainable in most situations. Large pattern angles in one direction and small angles in another (orthogonal) direction across the pattern have not been difficult to obtain with prior art devices. Useful conical spray patterns, for instance, with cone angles significantly larger than about 30 degrees, however, have not been achievable, particularly with even spray distribution in every direction across the pattern. Similar limitations have applied to pyramidal spray patterns.

Such limitations of the prior art are also especially restricting in applications wherein spatial design constraints or other requirements demand issuing a three-dimensional spray pattern substantially orthogonally with respect to the plane of the fluidic oscillator channel configuration. In this respect, it is often desirable to house the fluidic oscillator spray device such as to need as little as possible space or distance in the direction of the issuing spray. Hence, issuing the spray orthogonally to the plane of the oscillator channel configuration is desirable in such situations.

The spray-forming output device of the present invention avoids difficulties of the aforementioned kind and provides three-dimensional spray patterns while facilitating relatively large spray angles and substantially even spray distribution across the spray pattern.

Accordingly, an important overall feature of the invention is the provision of an improved spray-forming output device for fluidic oscillators and an improved method of channelling oscillating output flow from a fluidic oscillator to and through one or more outlets to generate a relatively wide-angle three-dimensional spray pattern of generally even spray distribution.

SUMMARY

In accordance with principles of the present invention, an improved spray-forming output device for fluidic oscillators is provided for generation of relatively wide-angle three-dimensional spray patterns of generally even spray distribution. The spray pattern issues in a substantially orthogonal direction with respect to the direction of two mutually counter-directed flow-guiding conduit portions of the output device. The spray-forming output device channels oscillating output flows received from the fluidic oscillator into these mutually counter-directed, flow-guiding conduits and to an interaction outlet region having at least one common outlet directed substantially orthogonally away from the directions of the conduits. The interaction outlet region is operative in facilitating interaction between the substantially mutually counter-directed oscillating output flows so that a three-dimensional spray pattern is produced in and at the region of the outlet and is issued therefrom into ambient. The resulting three-dimensional pattern can have relatively large angles and generally even spray distribution thereacross.

The spray-forming output device comprises at least two channels, each being connected at an entry end thereof with one of each output channel of a fluidic oscillator. In fluidic oscillators that do not provide discrete output channel structures, the entry ends of channels are disposed in appropriate locations in the oscillator's output region to receive alternating output flow streams therefrom. The two channels feed mutually counter-directed conduits having exit ends connected to an interaction outlet region. The interaction outlet region includes at least one common outlet that is directed substantially orthogonally with respect to a common axis about which the mutually counter-directed conduits are disposed.

In one embodiment, the interaction outlet region includes an impact wall disposed at the exit ends of the counter-directed conduits in proximity to the common outlet. The impact wall is oriented substantially orthogonally to the direction of flow through the counter-directed conduits and prevents fluid flows from directly passing from one conduit to the other.

In one embodiment the spray-forming output device further comprises a shunt inertance conduit that interconnects the entry ends of the counter-directed conduits. The shunt inertance conduit is operative in smoothing out the waveforms of the alternating flow output from the oscillator and also provides for a certain amount of load impedance matching between the oscillator outputs and the output device.

In operation of the spray-forming output device, a fluidic oscillator (or another means for providing alternatingly oscillating output flows) provides alternating output flows to the counter-directed conduits. These flows are deflected into the common outlet, mutually interact in the interaction outlet region; and, issue therefrom in the form of a substantially common fluid stream that oscillates or substantially sweeps from side to side in correspondence with the oscillation of the fluidic oscillator. The oscillating fluid stream issuing from the common outlet then breaks up into droplets and forms a three-dimensional spray pattern.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference numerals refer to like parts throughout different views. The drawings are schematic and not necessarily to scale, emphasis instead being placed upon illustrating principles of the invention.

DESCRIPTION OF PREFERRED EMBODIMENTS

Figure 1:
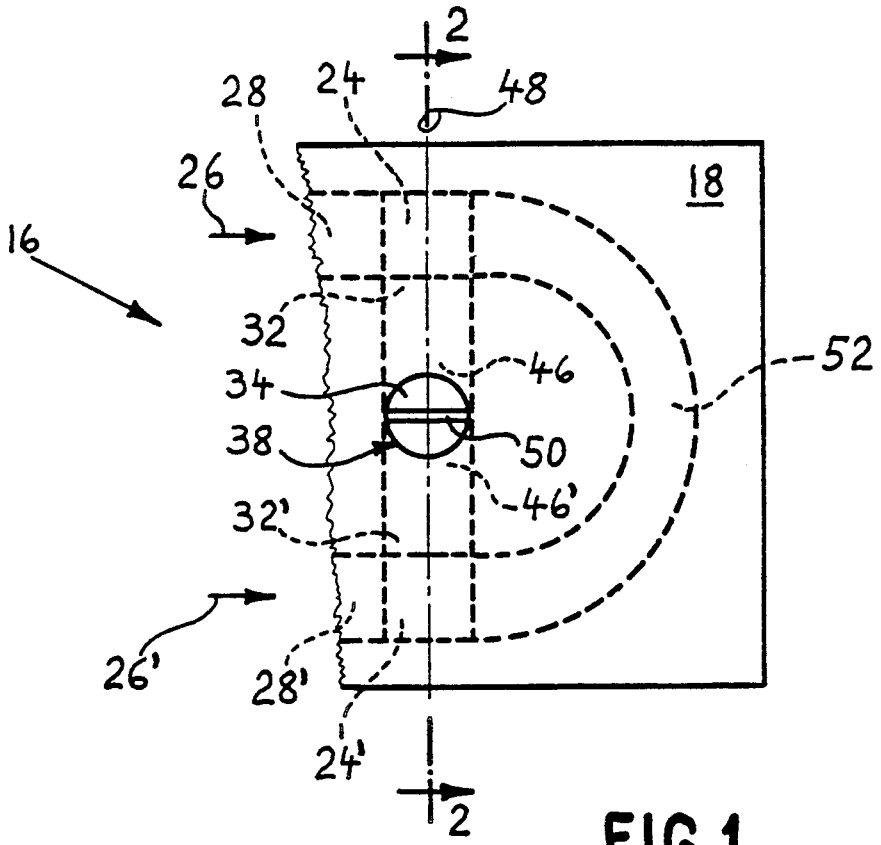
FIG. 1 is a schematic partial plan view of an embodiment of the spray-forming output device according to the invention showing internal channels and conduits represented by dashed lines.
Figure 2:
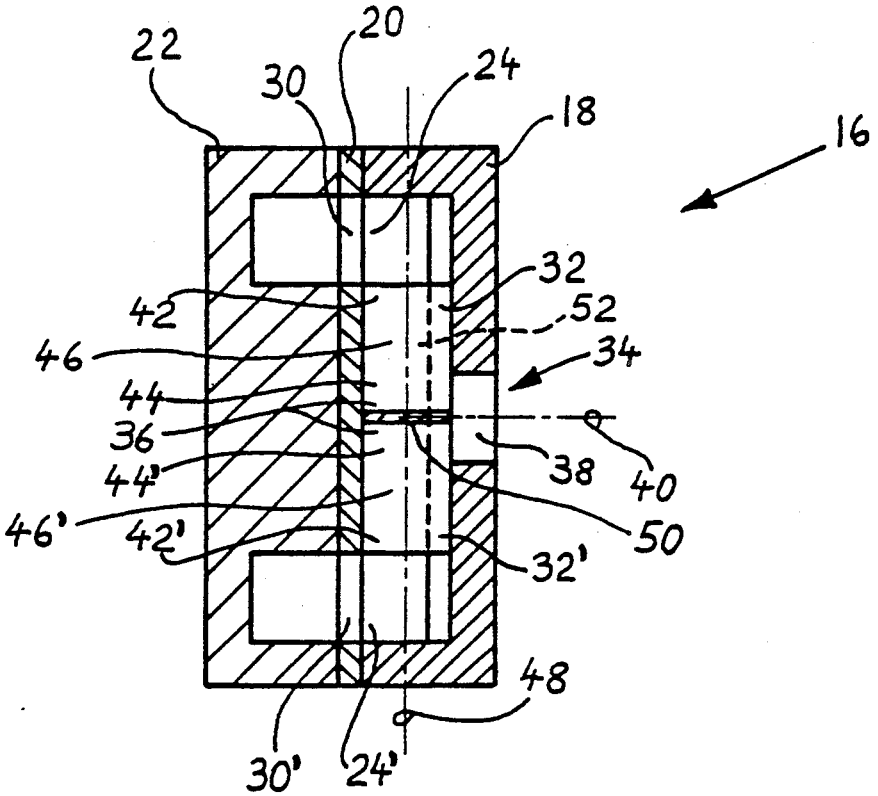
FIG. 2 is a schematic cross-sectional view along section lines 2—2 of FIG. 1.

Referring now to FIGS. 1 and 2, there is depicted an embodiment of a spray-forming output device 16 comprising an outlet lamina 18, a middle lamina 20, and a bottom lamina 22. Channels or conduits are formed in the laminae and the laminae are sealed with respect to one another so that fluid can be conducted through the conduits without leakage. The conduits are shown by dashed lines in FIG. 1, as they are hidden in and beneath outlet lamina 18 in this view.

The spray-forming output device 16 comprises two receiving means 24 and 24' to receive alternating oscillating output flows from means for providing such flows, such as, for example, a fluidic oscillator. Receiving means 24 and 24' are here shown in the form of rectilinear cavities that are fed from a fluidic oscillator (for example), as indicated by arrows 26 and 26', respectively, via connecting channels 28 and 28' through corresponding openings 30 and 30' in the middle lamina 20.

A pair of conduits 32 and 32' lead from receiving means 24 and 24', respectively, to an upstream region 36 of an interaction outlet 34. Interaction outlet 34 includes a common downstream outlet 38 which is shown here in the form of a circular bore. Outlet 38 can have other cross-sectional shapes to provide corresponding shapes to the output spray pattern issuing therefrom. Common downstream outlet 38 has an axis of symmetry 40. Conduits 32 and 32' each respectively include an entry region 42 and 42', an exit region 44 and 44', and a flow-straightening conduit portion 46 and 46' adjacent the exit region 44 and 44', respectively. The flow-straightening conduit portions 46 and 46' share a common centerline 48 therethrough and have walls that are substantially symmetrically disposed with respect to common centerline 48. In other words, flow-straightening conduit portions are oriented or counter-directed with respect to one another by 180 degrees. As shown, flow-straightening conduit portions 46 and 46' have parallel walls, although converging walls or other wall configurations that are substantially symmetrical about centerline 48 can be employed—the purpose of these conduit portions being the straightening and guiding of fluid flow therethrough. Entry regions 42 and 42' are connected to receiving means 24 and 24', respectively. Exit regions 44 and 44' connect with upstream region 36 (FIGS. 6 and 7) of the interaction outlet 34. At least the flow-straightening conduit portions 46 and 46' are mutually counter-directed at exit regions 44 and 44'. The axis of symmetry 40 orthogonally intersects the common centerline 48.

The spray-forming output device 16 further includes an impact wall 50 that is disposed between exit regions 44 and 44' and having surfaces disposed substantially orthogonally in relation to the common centerline 48. Impact wall 50 substantially extends over the cross-sectional area of flow-straightening conduit portions 46 or 46', but does not substantially extend into common downstream outlet 38 (of interaction outlet 34).

The spray-forming output device 16 further comprises a shunt inertance conduit 52 that interconnects receiving means 24 and 24'.

As shown here, the channels and cavities of device 16 are arranged symmetrically about a plane through wall 50. Hence, flow-straightening conduit portions 46 and 46' are of the same length. Asymmetrical arrangements can be employed, and this will generally cause a corresponding asymmetry in the output spray pattern, which may be desirable in some uses. All channels are shown to have rectilinear cross-sections, although circular or other cross-sections can be employed.

As illustrated in FIGS. 1 and 2, outlet 38 and its axis 40 are directed orthogonally with respect to the plane in which connecting channels 28 and 28' are disposed. Connecting channels 28 and 28' generally connect to (or are) the output channels of a substantially two-dimensional fluidic oscillator (for example as illustrated in FIGS. 8, 9, or 10 and 12) which provides alternating oscillating output flows to the spray-forming output device 16. Hence, outlet 38 is directed orthogonally to the plane of the fluidic oscillator. However, depending upon the desired output, it will be appreciated that the outlet 38 can be directed at other angles, provided that it is substantially orthogonal to the common centerline 48.

Figure 3:
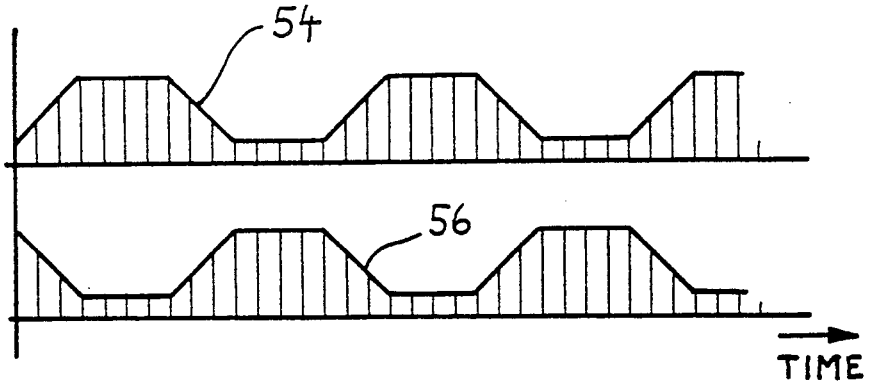
FIG. 3 is a diagrammatic representation of a general form of alternatingly oscillating output pulses (in dependence on time) provided to receiving means of the spray-forming output device.
Figure 4:
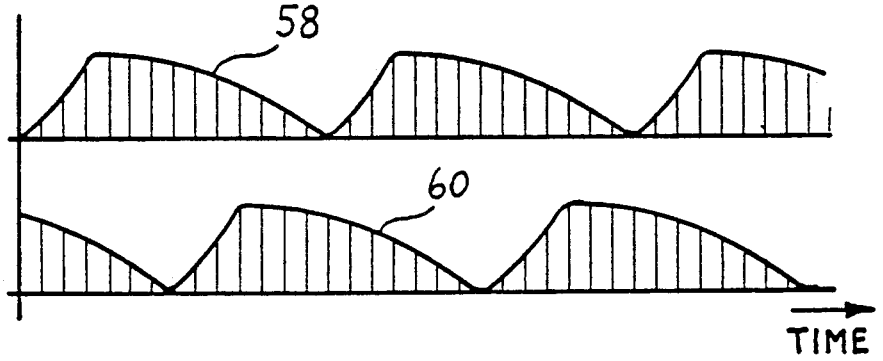
FIG. 4 is a diagrammatic representation of another form of alternatingly oscillating output pulses (in dependence on time) provided to receiving means of the spray-forming output device.

In operation, a fluidic oscillator, for example, feeds alternating, oscillating flows via connecting channels 28 and 28' through receiving means 24 and 24', respectively, and therefrom into conduits 32 and 32', respectively. (Examples of typical alternating, oscillating output pulses or flows are schematically illustrated in FIGS. 3 and 4.)

Portions of the flows received in receiving means 24 and 24' are also shunted thereacross through shunt inertance conduit 52, but in some situations, shunting through conduit 52 can be omitted.

In upstream region 36 of interaction outlet 34, the flows directed through conduits 32 and 32' impact substantially orthogonally upon impact wall 50 and are redirected toward and through common downstream outlet 38. Impact wall 50 may be omitted in some situations, but, in the absence of impact wall 50, the mutually counter-directed flows (through conduits 32 and 32') impact upon one another and are similarly re-directed toward and through common downstream outlet 38.

Figure 5:
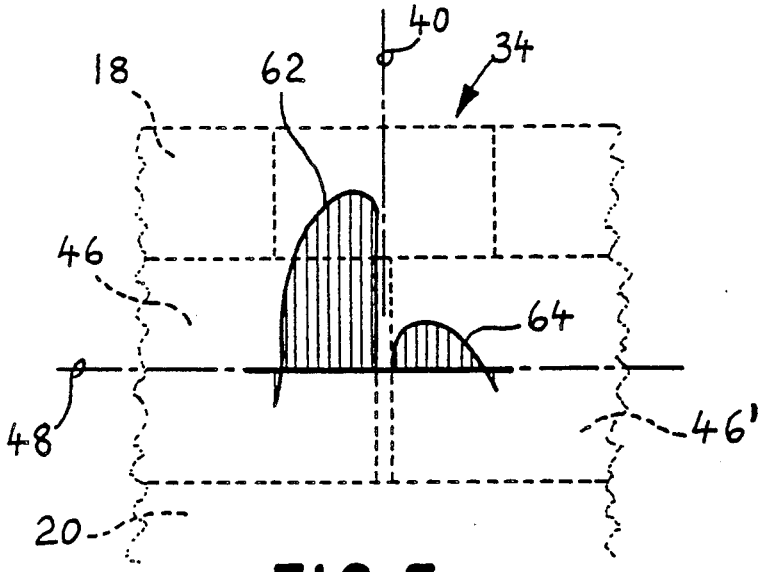
FIG. 5 is a diagrammatic flow profile representation in a common outlet, for instance in the one is shown in FIGS. 1 and 2.

The re-directed flows combine, in the presence of impact wall 50, downstream from impact wall 50. In the absence of impact wall 50, the re-directed flows begin to combine during their initial re-direction in upstream region 36. Just prior to any substantial combining and at the start of the combining of the re-directed flows, the redirected flows have a flow profile of flow components directed toward outlet 38 of a kind illustrated, for example, in FIG. 5. The particular profile shown in FIG. 5 is generally representative of the flow status at an instance of the oscillation cycle corresponding to a highest flow rate from the left side and a lowest flow rate from the right side. It will be understood, however, that the amplitude of the left-side profile 62 diminishes while amplitude of the right-side profile 64 increases as the oscillation proceeds until the right-side amplitude reaches its maximum. Thereafter, the process becomes side-reversed. Hence, the shown profile alternatingly oscillates as a consequence of the alternating, oscillating output pulses provided through conduits 32 and 32'.

As the re-directed flows combine, they mutually interact (by pressure and momentum interchange effects and by viscous interaction) and thusly combine into a substantially common flow stream. Prior to substantial combination of the re-directed flows, their flow profile (across the flows) is typically of a transversely alternating oscillating kind, as indicated in the foregoing (as in FIG. 5).

Figure 6:
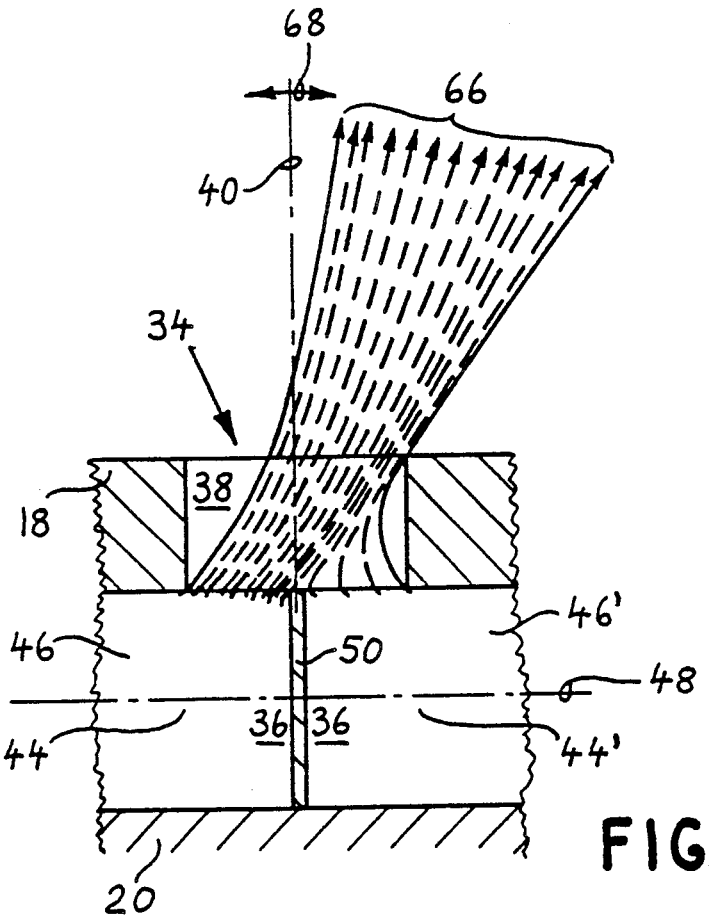
FIG. 6 is a schematic representations of a flow pattern of the combined interacting flows in a common outlet, for instance as originating from the flow profile indicated in FIG. 5.

Referring now to FIG. 6, as mutual interaction proceeds during the combining of the re-directed flows, the common flow stream is converted into a substantially transversely alternating side-to-side oscillating flow stream 66 by mutual interaction of flow profile components of the re-directed flows. Mutual interaction continues while stream 66 issues from the common downstream outlet 38 into ambient. Hence, stream 66 sweeps in an oscillatory manner from side to side in the direction of double arrow 68 and provides a three-dimensional output spray pattern. In so doing, it breaks up into droplets generally at some small distance downstream from the outlet 38.

Figure 7:
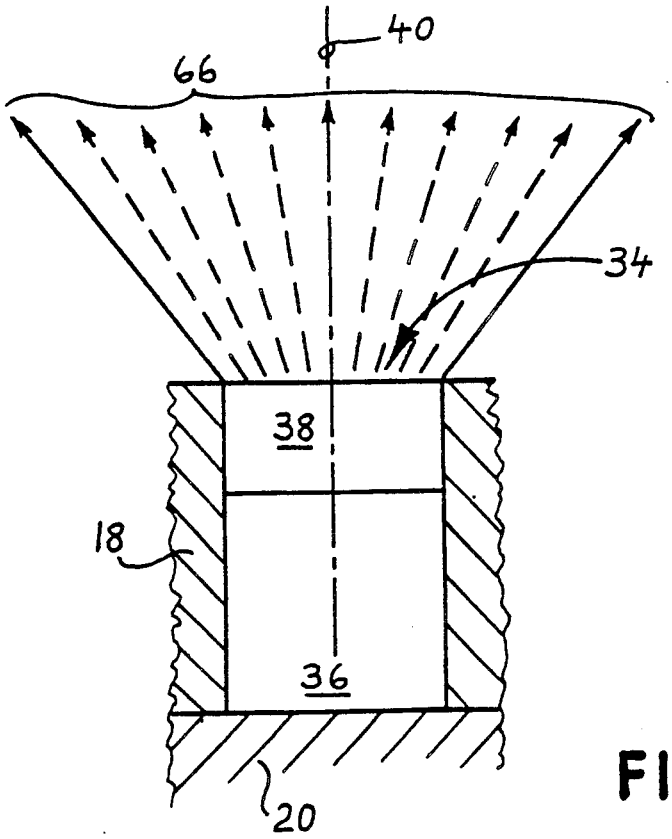
FIG. 7 is a schematic transverselly orthogonal illustration of the flow pattern in FIG. 6, particularly showing the external extent of the pattern.

The particular momentary stream status (momentary deflection state) shown in FIG. 6 generally corresponds to the momentary state at a given time of the flow profile such as illustrated in FIG. 5. FIG. 7 illustrates this stream 66 in a viewing direction that is at a right angle with respect to the plane of the depiction of FIG. 6. Upstream region 36 is depicted in FIG. 7 without having the impact wall sectioned. Alternately, FIG. 7 can be representative of an embodiment in which impact wall 50 (of FIGS. 1, 2, and 6) is omitted.

Referring now more particularly to FIGS. 3 and 4, there are diagrammatically illustrated two examples of output flow pulse waveforms that are generally provided by means for providing alternating oscillating output flows, for instance fluidic oscillators (as illustrated, for example, in FIGS. 8, 9, or 10 and 12). FIG. 3 shows a first waveform 54 and a second waveform 56. FIG. 4 shows a first waveform 58 and a second waveform 60.

The amplitude of each waveform is plotted in the direction of the abscissa and time is plotted along the ordinate. The two waveforms of each FIGURE are identical except that they are phase-shifted with respect to one another by about 180 degrees or one half of an oscillation cycle in time.

If desired, different phase-shifts can be obtained by using different fluidic oscillators to feed the spray-forming output device of the invention to obtain asymmetrical output spray patterns. The waveforms can vary depending on the particular oscillator employed and on particular impedance matching between the oscillator and the output device. Changes to the shunt inertance conduit 52 (FIGS. 1 and 2), for example, can serve to vary impedance matching and thereby the waveforms. That is, different lengths and cross-sectional areas of conduit 52 will provide different matching. Changes in cross-sectional areas and channel lengths, shapes, and other cavity dimensions in oscillators and output devices can similarly effect changes in matching and waveforms. Smoothing of the pulse waveforms and different degrees of modulation can also be provided by appropriate fluid channel or conduit configuration. For instance, inertance increases of conduit 52 can increase the degree of modulation. In this respect, FIG. 4 shows waveforms having a higher degree of modulation than the waveforms of FIG. 3, in that waveforms 58 and 60 reach down to zero flow. Negative flow values can also be obtained, if so desired.

Figure 8:
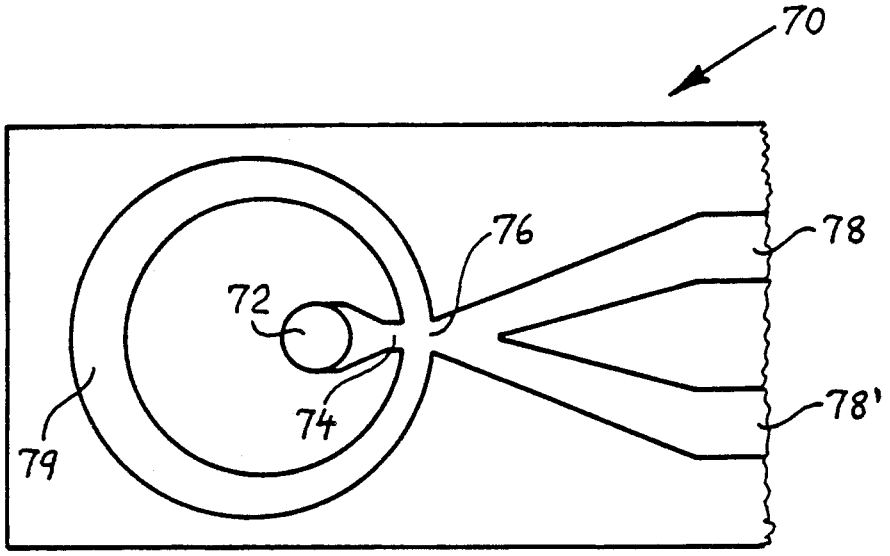
FIG. 8 PRIOR ART
FIG. 8 is a schematic illustration in plan view of a fluidic oscillator for feeding alternatingly oscillating output flows to a spray-forming output device of the invention, for instance the device depicted in FIGS. 1 and 2.

FIG. 8 schematically depicts an example of a configuration of a conventional fluidic oscillator which can be employed in combination with the spray-forming output device of the present invention. This particular oscillator configuration is commonly called a "loop-oscillator" in the art and it is basically similar to the fluid oscillator disclosed in U.S. Pat. No. 3,016,066. Many variations of this configuration are known in the art. Loop oscillator 70 comprises various channels. In particular a supply inlet 72 receives supply pressure and flow substantially orthogonally to the plane of the configuration; and, a power nozzle 74 directs supply flow in the plane of the configuration and forms a power jet issuing into an interaction region 76 and therefrom into output channels 78 and/or 78'. An inertance loop 79 interconnects opposite sides of the interaction region 76.

In basic operation, the power jet is unstable in its central position and tends to deflect to either side of the interaction region 76. Consequently, the resulting differential pressure transverselly across the power jet induces a lagging flow in inertance channel loop 79. This induced flow interacts with the power jet to redirect it toward the other side of the interaction region 76. Hence, the power jet oscillates from side to side in interaction region 76 and thereby issues alternating oscillating output flows through output channels 78 and 78'. In a sprayer combination of the invention, output channels 78 and 78' are connected directly (or via connecting channels 28 and 28') to receiving means 24 and 24' (FIGS. 1 and 2), respectively.

Figure 9:
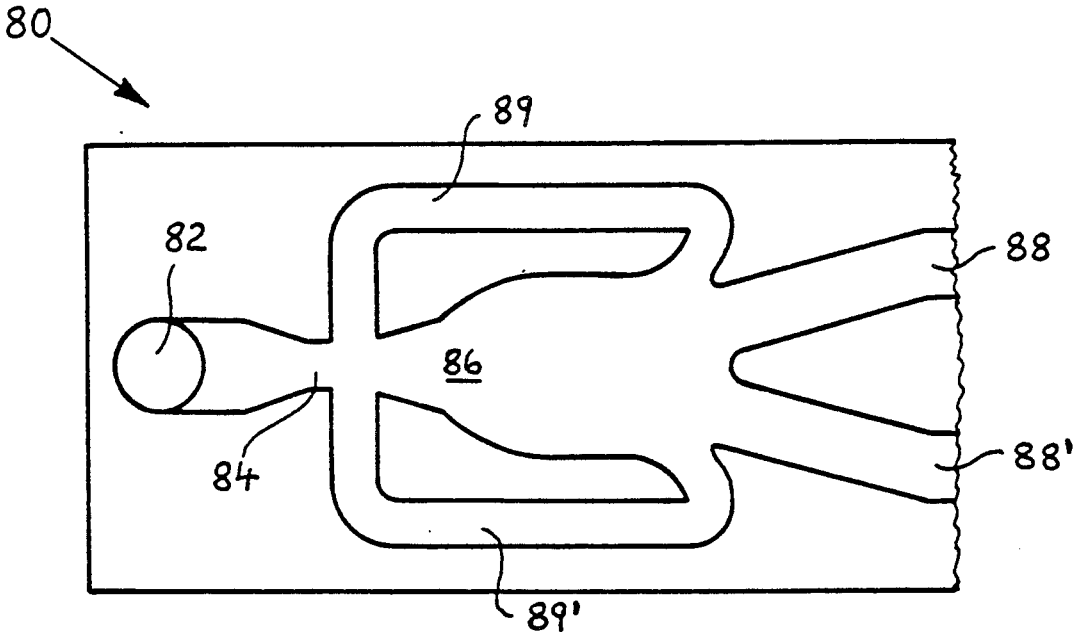
FIG. 9 PRIOR ART
FIG. 9 is a schematic illustration in plan view of another fluidic oscillator for feeding alternatingly oscillating output flows to a spray-forming output device of the invention, for instance the device depicted in FIGS. 1 and 2.

FIG. 9 schematically depicts another example of a conventional fluidic oscillator which can be employed in combination with the spray-forming output device of the present invention. This particular oscillator configuration is related to a number of different oscillators known in the art, for example portions are similar to fluidic oscillators disclosed in U.S. Pat. Nos. 3,507,275; 3,741,481; 4,052,002; and, 4,463,904. Numerous variations of such configurations are known in the art.

FIG. 9 shows an output feedback oscillator 80 that comprises various channels and cavities as shown. In particular a supply inlet 82 that receives supply pressure and flow substantially orthogonally to the plane of the configuration (but can receive its supply fluid alternately in the configuration plane); and, a power nozzle 84 directs supply flow in the plane of the configuration and forms a power jet issuing into an interaction region 86 and therefrom into output channels 88 and/or 88'. Respective upstream sides of interaction region 86 and respective downstream side regions are connected by feedback channels 89 and 89' to conduct feedback signals therethrough.

In basic operation, the power jet is unstable in its central position and tends to deflect to either side of the interaction region 86. The asymmetrically deflected power jet differentially influences the feedback signals through feedback channels 89 and 89', and thusly provides a lagging differential signal across the power jet in the upstream portion of interaction region 86 such as to oppose the power jet's deflection. Consequently, the power jet is deflected to the opposite side in interaction region 86. Hence, the power jet oscillates from side to side in interaction region 86 and thereby provides alternating oscillating output flows through output channels 88 and 88'. In a sprayer combination of the invention, output channels 88 and 88' are connected directly (or via connecting channels 28 and 28') to receiving means 24 and 24' (FIGS. 1 and 2), respectively.

Figure 10:
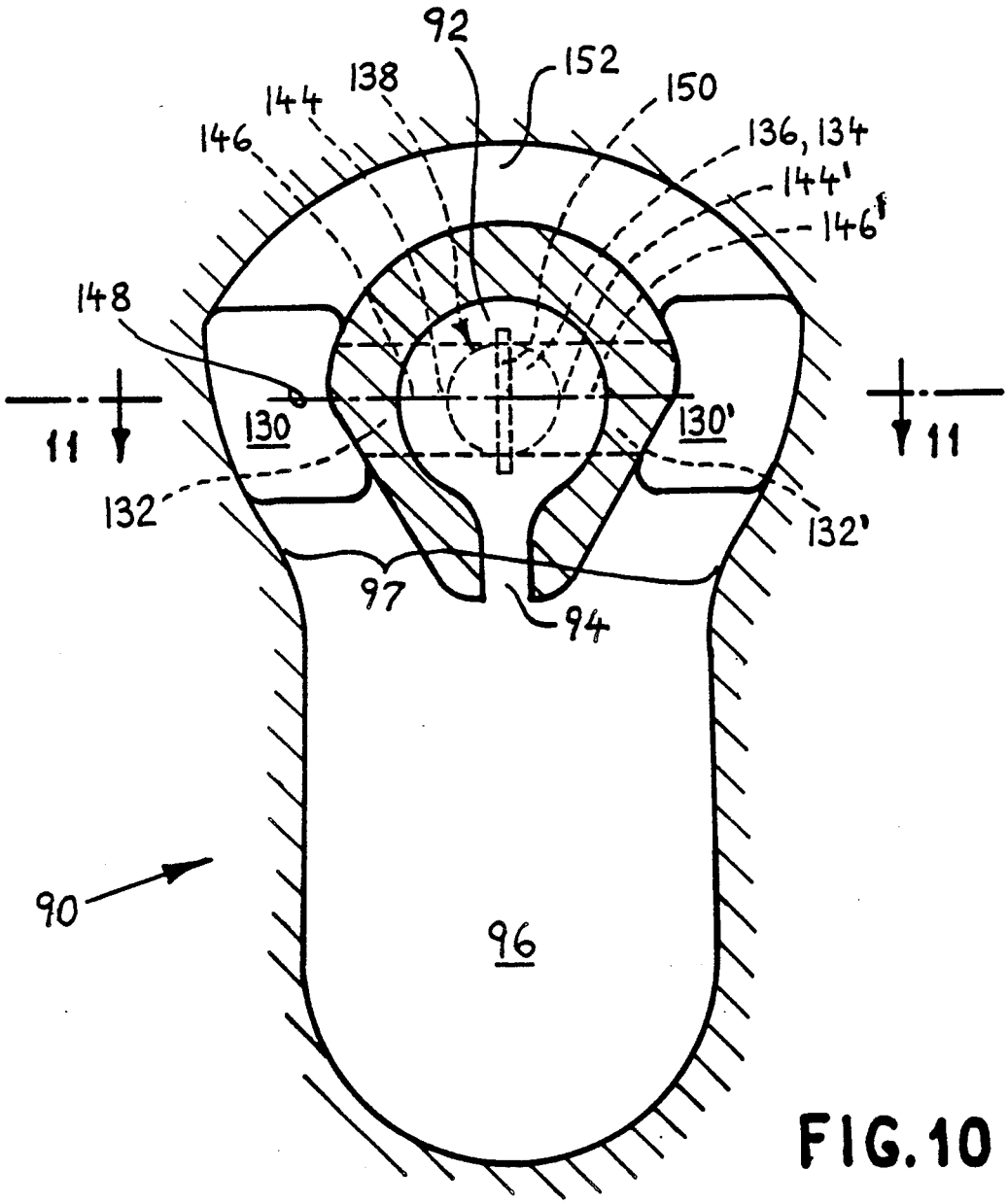
FIG. 10 is a schematic plan view section (taken along section lines 10—10 in FIG. 11) of an embodiment of the present invention.
Figure 11:
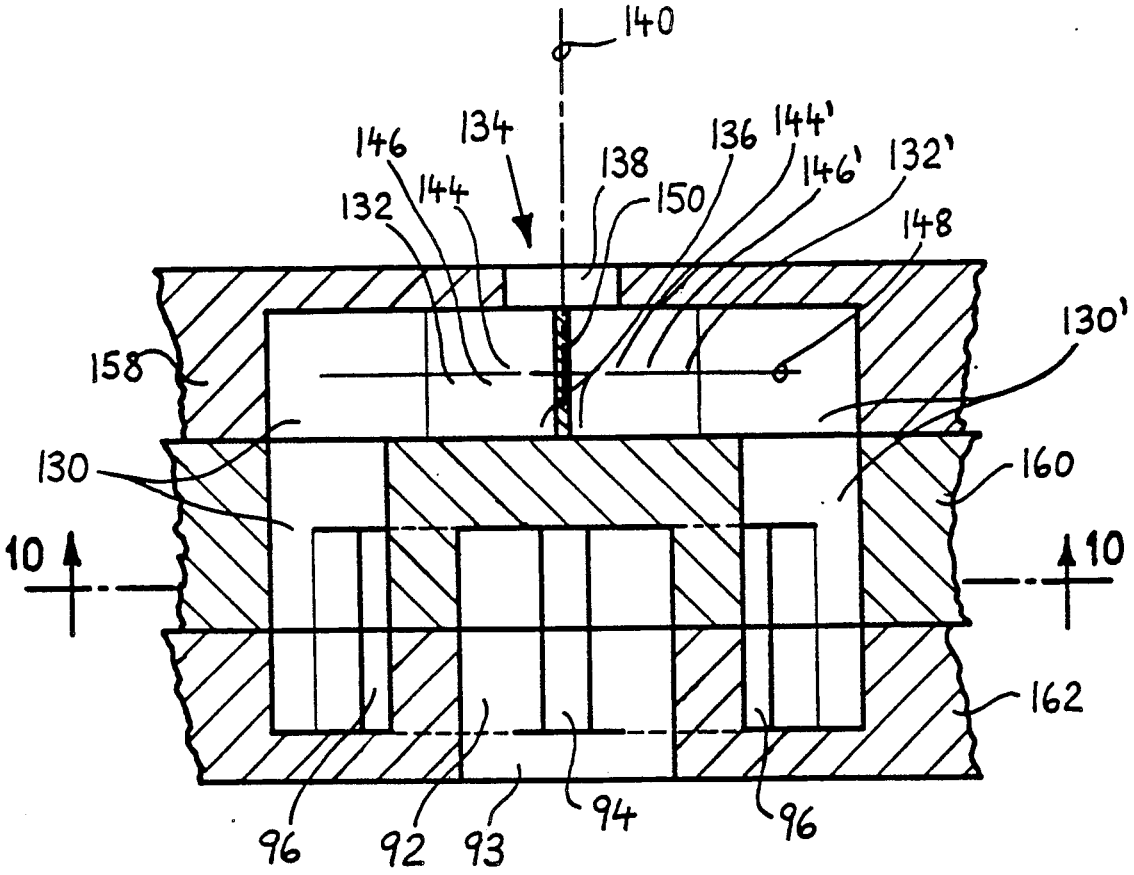
FIG. 11 is a schematic cross-sectional view along section lines 11—11 of FIG. 10.
Figure 12:
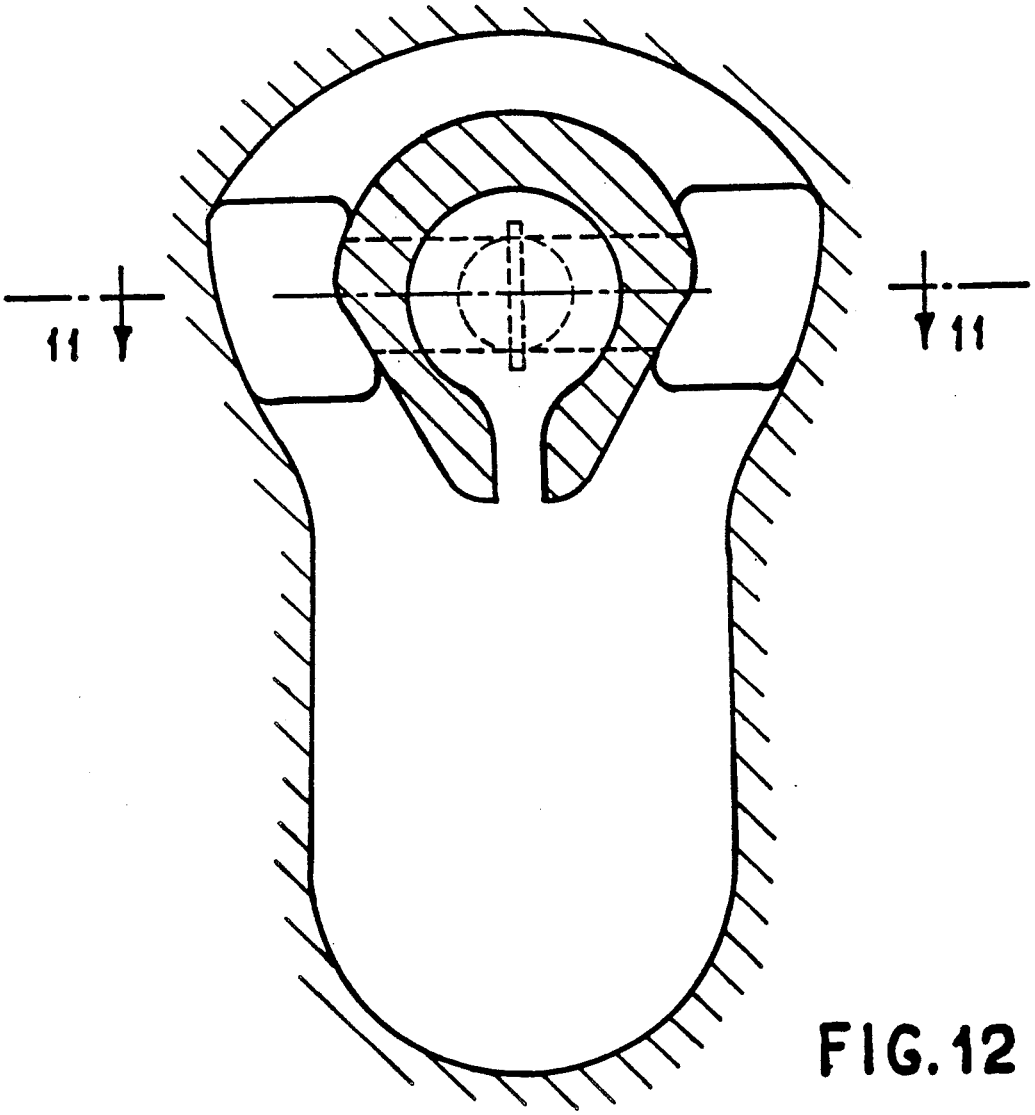
FIG. 12 is a schematic illustration in plan view of the portion of the embodiment shown in FIG. 10, indicating typical dimensions.

FIGS. 10, 11, and 12, illustrate a preferred embodiment of the invention. The FIG. 10 embodiment includes a planar depiction of a two-dimensional oscillator configuration of U.S. Pat. No. 4,184,636 (for instance in FIGS. 1 and 2, 22, and 23), which is included herein by reference. The fluidic oscillator 90 (included in instant FIGS. 10, 11, and 12) comprises a supply cavity 92 that is fed with supply fluid through a supply opening 93 (FIG. 11) directed orthogonally to the plane of the configuration. Supply cavity 92 feeds fluid under pressure to nozzle means 94. Nozzle means 94 forms and issues a fluid jet into an oscillation chamber 96 through a common inlet and outlet opening 97 (of the chamber 96). The oscillation chamber 96 includes means for cyclically oscillating the fluid jet back and forth across chamber 96 in a direction substantially transverse to the direction of flow in the jet. The means for cyclically oscillating include end and side walls of chamber 96. Further, the chamber 96 includes flow directing means for directing fluid from the cyclically oscillated jet out of chamber 96 through the common inlet and outlet opening 97. The flow directing means also include end and side walls of chamber 96.

The illustration of FIGS. 10, 11, and 12 also include the spray-forming output device of the invention, including two receiving means 130 and 130' for receiving alternating oscillating output flows, each of the receiving means 130 and 130' being located at an opposite side of the common inlet and outlet opening 97. Receiving means 130 and 130' are cavities that include openings in the floor of the chamber configuration of oscillator 90. These openings lead and are connected respectively to a pair of conduits 132 and 132' disposed beneath this floor. Conduits 132 and 132' lead from receiving means 130 and 130', respectively, to an upstream region 136 of an interaction outlet 134. Interaction outlet 134 includes a common downstream outlet 138 which is shown here in the form of a circular bore. Outlet 138 has an axis of symmetry 140 and can have other cross-sectional shapes to provide corresponding shapes to the output spray pattern issuing therefrom.

Conduits 132 and 132' each respectively include an exit region 144 and 144', and a flow-straightening conduit portion 146 and 146' adjacent the exit region 144 and 144', respectively. The flow-straightening conduit portions 146 and 146' define a common centerline 148 therethrough and have walls that are substantially symmetrically disposed with respect to common centerline 148. In other words, flow-straightening conduit portions are oriented or counter-directed with respect to one another by 180 degrees.

Flow-straightening conduit portions 146 and 146' have parallel walls, although, for instance, converging walls or other wall configurations that are substantially symmetrical about centerline 148 can be employed—the purpose of these conduit portions being to straighten and guide fluid flow therethrough. Exit regions 144 and 144' connect with upstream region 136 of the interaction outlet 134. At least the flow-straightening conduit portions 146 and 146' are mutually counter-directed at exit regions 144 and 144'. The axis of symmetry 140 intersects orthogonally the common centerline 148.

An impact wall 150 is disposed between exit regions 144 and 144' and has surfaces disposed substantially orthogonally in relation to the common centerline 148. Impact wall 150 substantially extends over the cross-sectional area of flow-straightening conduit portions 146 or 146', but does not substantially extend into common downstream outlet 138 (of interaction outlet 134).

The spray-forming output device further comprises a shunt inertance conduit 152 that interconnects receiving means 130 and 130'.

The channels and cavities of the combination of fluidic oscillator 90 and the spray-forming device are arranged symmetrically about a plane through wall 150. Hence, flow-straightening conduit portions 146 and 146' are illustrated as being of the same length. Asymmetrical arrangements can be employed, however, and this will generally cause a corresponding asymmetry in the output spray pattern, which may be desirable in some uses. All channels are shown to have rectilinear cross-sections, although circular or other cross-sections can be employed.

As illustrated in FIGS. 10 and 11, outlet 138 and its axis 140 are directed orthogonally to the plane in which the substantially two-dimensional fluidic oscillator 90 is disposed. However, it will be appreciated that the outlet 138 can be directed at other angles, provided that it is substantially orthogonal to the common centerline 148.

In brief operation of the combination device of fluidic oscillator 90 and the spray-forming device shown in FIGS. 10–12, fluidic oscillator 90 provides alternating oscillating output flow pulses and feeds these flow pulses through common inlet and outlet opening 97 to receiving means 130 and 130', and therefrom into conduits 132 and 132', respectively. Examples of alternating oscillating output pulses or flows are schematically illustrated in FIGS. 3 and 4. Portions of the flows received at receiving means 130 and 130' are also shunted thereacross through shunt inertance conduit 152. In some situations, shunting through conduit 152 can be omitted. In upstream region 136 of interaction outlet 134, the flows directed through conduits 132 and 132' impact substantially orthogonally upon impact wall 150 and are re-directed toward and through common downstream outlet 138. Impact wall 150 may be omitted in some situations. In the absence of impact wall 150, the mutually counter-directed flows (through conduits 132 and 132') impact upon one another and are similarly redirected toward and through common downstream outlet 138.

The re-directed flows combine, in the presence of impact wall 150, downstream from impact wall 150. In the absence of impact wall 150, the re-directed flows begin to combine during their initial re-directing in upstream region 136. Just prior to any substantial combining and at the start of the combining of the redirected flows, the redirected flows have a flow profile of flow components directed toward outlet 138 of a kind illustrated in FIG. 5. This flow profile has been described in conjunction with the operation of the embodiments shown in FIGS. 1 and 2 and is equally applicable to the operation of the embodiments shown in FIGS. 10–12. In this respect, reference numerals in FIG. 5 correspond to those of FIGS. 1 and 2, but can be easily understood to apply to FIGS. 10–12. The same considerations apply to FIGS. 6 and 7. Hence, the description presented in conjunction with FIGS. 6 and 7 is equally applicable to the operation of the embodiments shown in FIGS. 10–12. The assembly of to FIG. 11 is comprised of three laminae, namely an outlet lamina 158, a middle lamina 160, and a bottom lamina 162. Channels, conduits, and chambers are formed in the laminae and the laminae are sealed with respect to one another so that fluid can be conducted through the conduits without leakage. The outlet lamina 158 includes conduits 132 and 132' and interaction outlet 134. The middle lamina 160 and the bottom lamina 162 each include a planar portion of fluidic oscillator 90 and a portion of receiving means 130 and 130'. Middle lamina 160 further includes connecting openings for the receiving means to connect to conduits 132 and 132'. Bottom lamina 162 also includes supply opening 93 through which fluid is supplied via the supply cavity 92 to nozzle means 94 from a source of pressurized fluid flow that is not shown here.

The FIG. 12 structure is substantially identical to FIG. 10, except that reference numerals have been omitted and main dimensions for a preferred embodiment specified thereby have been added. A preferred depth of conduits 132 and 132' in outlet lamina 158 is 0.180 inches and a preferred depth of the chamber and channels of oscillator 90, as well as of shunt inertance conduit 152, is 0.312 inches (extending into laminae 160 and 162). The ratio of the outlet cross-sectional area (of common downstream outlet 138) divided by the nozzle cross-sectional area (of nozzle means 94) has been found to be an important parameter affecting performance. This ratio is 1.076 for the preferred embodiment for which dimensions are provided in FIG. 12. Advantageous performance is obtainable, however, when this ratio is in the range of about 0.8 to 1.3.

Linear scaling of measurements over large ranges can be performed without affecting the basic operation and function, except insofar as changes in cross-sectional areas of various flow-conducting elements will correspondingly change flow throughput. Hence, various operating parameters such as for example given by oscillation frequency pressure/flow relationships, droplet size in issuing spray, and the like will change correspondingly as a consequence of size-scaling. More particularly, linear scaling of planar dimensions of the combination device of the invention will provide corresponding substantially linear changes in operating parameters such as for example given by oscillation cycle time, flow rates, etc.; and linear scaling of depths of channels, conduits (including cross-sectional area of outlet 38), and of depth of oscillator 90 will provide substantially corresponding linear changes in flow throughput rates.

The foregoing descriptions of operation might have given the impression that the working fluid is a liquid and that the liquid is issued into an ambient air environment. The present invention, however, can be operated also with gaseous working fluids in gaseous environments; with liquid working fluids in liquid environments; and, with suspended-solids working fluids in gaseous or liquid environments.

While the invention has been particularly shown and described with reference to preferred embodiments thereof, it will be understood by those skilled in the art that various changes and modifications in form and details may be made therein without departing from the spirit and scope of the invention.

The embodiments of the invention in which an exclusive property or privilege is claimed are defined as follows:

1. A spray-forming output device comprising:

dual input receiving means for receiving an alternating, oscillating fluid flow;

a pair of conduits, each said conduit of said pair including an entry region and an exit region and having a flow-straightening conduit portion adjacent said exit region, said flow-straightening conduit portions defining a common centerline therethrough and having walls substantially symmetrically disposed with respect to said common centerline, each of said entry regions being connected to an input of said dual input receiving means, said flow-straightening conduit portions of said pair of conduits being mutually counter-directed; and, an interaction outlet having an upstream region and a common downstream outlet, said conduits of said pair being connected at said exit regions to said upstream region and said common downstream outlet having an axis of symmetry that substantially orthogonally intersects said common centerline.

2. The device according to claim 1, wherein said interaction outlet includes an impact wall disposed between said exit regions, said impact wall having surfaces disposed substantially orthogonally to said common centerline.

3. The device according to claim 1, further comprising a shunt inertance conduit interconnecting said two receiving means.

4. The device according to claim 1, wherein said flow-straightening conduit portion is substantially parallel-walled.

5. The device according to claim 1, wherein said common downstream outlet is a bore having a substantially circular cross-section.

6. The device according to claim 1, wherein said flow-straightening conduit portions are of substantially equal lengths and have a substantially rectilinear cross-section.

7. The device according to claim 1, including a fluid oscillator having a channel and chamber configuration in a given plane for providing said alternating, oscillating fluid flow to said dual input receiving means and wherein said common downstream outlet is directed substantially orthogonally with respect to said plane in which said channel and chamber configuration of said fluidic oscillator is disposed.

8. A sprayer combination for issuing into ambient an oscillating output spray pattern, the combination comprising means for providing alternating, oscillating output flows and a spray-forming output device connected thereto for receiving said output flows, said device comprising:

two receiving means to receive the alternating, oscillating output flows;

a pair of conduits, each said conduit of said pair including an entry region and an exit region and having a flow-straightening conduit portion adjacent said exit region, said flow-straightening conduit portions defining a common centerline therethrough and having walls substantially symmetrically disposed with respect to said common centerline, each of said entry regions being connected to one of said two receiving means, said flow-straightening conduit portions of said pair of conduits being mutually counter-directed; and an interaction outlet having an upstream region and a common downstream outlet, said conduits of said pair being connected at said exit regions to said upstream region and said common downstream outlet having an axis of symmetry that substantially orthogonally intersects said common centerline, said oscillating output spray pattern issuing from said common downstream outlet.

9. The sprayer combination in accordance with claim 8, wherein said interaction outlet includes an impact wall disposed between said exit regions, said impact wall having surfaces disposed substantially orthogonally with respect to said common centerline.

10. The sprayer combination in accordance with claim 8, further comprising a shunt inertance conduit interconnecting said two receiving means.

11. The sprayer combination in accordance with claim 8, wherein said means for providing alternating oscillating output flows comprises a fluidic oscillator.

12. The sprayer combination in accordance with claim 11 wherein said fluidic oscillator comprises:

nozzle means for forming and issuing a jet of fluid in response to application thereto of fluid under pressure; and, an oscillation chamber having a common inlet and outlet opening, said oscillation chamber being positioned to receive said jet of fluid from said nozzle means through said common opening.

13. The sprayer combination of claim 12 wherein said oscillation chamber includes:

oscillation means for cyclically oscillating said jet back and forth across said chamber in a direction substantially transverse to the direction of flow in said jet;

flow directing means for directing fluid from the cyclically oscillated jet out of said chamber through said common inlet and outlet opening; and, wherein each of said two receiving means of said spray-forming output device is located at an opposite side of said common inlet and outlet opening.

14. The sprayer combination in accordance with claim 11, wherein said common downstream outlet has an outlet cross-sectional area; said nozzle means has a nozzle cross-sectional area; and, wherein the ratio of said outlet cross-sectional area divided by said nozzle cross-sectional area is in the range of about 0.8 to 1.3.

15. The sprayer combination of claim 12, wherein said common downstream outlet is directed substantially orthogonally with respect to the plane in which said oscillation chamber is disposed.

16. The sprayer combination in accordance with claim 8, wherein said flow-straightening conduit portion is substantially parallel-walled.

17. The sprayer combination in accordance with claim 8, wherein said common downstream outlet is a bore having a substantially circular cross-section.

18. The sprayer combination in accordance with claim 8, wherein said flow-straightening conduit portions are of substantially equal lengths and have a substantially rectilinear cross-section.

19. A method of providing an oscillating output spray pattern from two alternating oscillating flows channelled through a spray-forming output device for issuing into ambient, the method comprising steps of:

receiving said two alternating oscillating output flows in two receiving means, respectively;

feeding said alternating oscillating output flows each from one of said two receiving means through one of a pair of conduits, said conduits each having an exit region and having a flow-straightening conduit portion adjacent said exit region, said flow-straightening conduit portions defining a common centerline therethrough;

counter-directing with respect to one another said alternating oscillating output flows at said exit regions substantially along said common centerline through said flow-straightening conduit portions;

re-directing said alternating oscillating output flows at and downstream from said exit regions substantially adjacently along one another toward a common direction that is substantially orthogonal with respect to the direction of said counter-directing, the re-directed said alternating oscillating output flows defining a flow profile of flow components in said common direction;

alternatingly oscillating said flow profile transversely to said common direction as a consequence of the alternating oscillation of said alternating oscillating output flows and thereby providing a transversely-alternating oscillating flow profile;

causing mutual interaction between the re-directed said alternating oscillating output flows in an interaction outlet downstream from said exit regions and thereby combining said alternating oscillating output flows into a substantially common flow stream initially having said transversely-alternating oscillating flow profile thereacross;

converting said common flow stream having said transversely-alternating oscillating flow profile thereacross substantially to a transversely-alternating side-to-side oscillating flow stream by mutual interaction of flow profile components of said transversely-alternating oscillating flow profile; and issuing said transversely alternating side-to-side oscillating flow stream from a common outlet in the form of said oscillating output spray pattern.

20. The method of claim 19, for use in a spray-forming output device having an impact wall disposed between said exit regions substantially orthogonally to the direction of said counter-directing, said method further comprising a step of impacting said alternating oscillating output flows substantially orthogonally onto surfaces of said impact wall.

21. The method of claim 19, further comprising a step of partially shunting said alternating oscillating output flows through a shunt inertance conduit connected between said two receiving means.

22. The method of claim 19, wherein said alternating oscillating output flows are received from a fluid oscillator having an oscillation channel and chamber configuration in a given plane and wherein said steps of redirecting and issuing are effected in a direction that is substantially orthogonal with respect to the plane of said oscillation channel and chamber configuration of said fluidic oscillator.

* * * * *